US007750542B2

(12) United States Patent
Kling et al.

(10) Patent No.: US 7,750,542 B2
(45) Date of Patent: Jul. 6, 2010

(54) LAMP WITH A CLIPPED-ON CONTACT

(75) Inventors: Michael R. Kling, Lexington, KY (US); Jeffrey P. Buschmann, Lexington, KY (US); Michael J. Swantner, Saxonburg, PA (US)

(73) Assignee: Osram Sylvania Inc., Danvers, MA (US)

( * ) Notice: Subject to any disclaimer, the term of this patent is extended or adjusted under 35 U.S.C. 154(b) by 741 days.

(21) Appl. No.: 11/515,682

(22) Filed: Sep. 5, 2006

(65) Prior Publication Data

US 2008/0054775 A1 Mar. 6, 2008

(51) Int. Cl.
*H01J 5/48* (2006.01)

(52) U.S. Cl. ..... 313/113; 313/318.1; 439/615

(58) Field of Classification Search ..... 313/113, 313/318.1; 439/615
See application file for complete search history.

(56) References Cited

U.S. PATENT DOCUMENTS 4,855,634 A * 8/1989 Gagnon et al. ..... 313/113
5,057,735 A 10/1991 Zalar et al.
5,744,901 A * 4/1998 Friederichs et al. ..... 313/113
7,514,872 B2 4/2009 Smith et al.
2007/0069652 A1 * 3/2007 Smith et al. ..... 313/634

OTHER PUBLICATIONS

Applicants' co-pending application, U.S. Appl. No. 11/515,742, filed Sep. 5, 2006.

* cited by examiner

*Primary Examiner*—Joseph L Williams
(74) *Attorney, Agent, or Firm*—Edward S. Podszus

(57) ABSTRACT

A lamp includes a reflector having a passageway opening to a heel of the reflector, a lamp capsule having a lead that extends rearward through the passageway, a conductive clip that spans a diameter of the heel and that has tabs that extend forward at opposite sides of the heel and an arm that extends rearward, the arm being attached to a portion of the lead that projects out of the passageway, and a base that is attached to the heel and that engages the tabs at the opposite sides of the heel. The arm holds the lamp capsule in place and electrically connects the lamp capsule to the base. The arm may be a semi-detached central portion of the clip that is bent to be substantially parallel to an axis of the lead.

23 Claims, 4 Drawing Sheets

LAMP WITH A CLIPPED-ON CONTACT

TECHNICAL FIELD

The invention relates to electric lamps and particularly to electric lamps with reflectors. More particularly the invention is concerned with a lamp capsule supported in a reflector.

BACKGROUND ART

The present invention is directed to an electric lamp and more particularly to a parabolic aluminized reflector (PAR) lamp and a method of making a PAR lamp.

A PAR lamp typically includes a light source, such as a tungsten halogen capsule, mounted in a pressed borosilicate glass reflector with a reflective coating applied to the inner parabolic surface. A pressed glass lens usually covers the front aperture and contains optical elements to give the desired beam shape. General service PAR lamps usually have a neck region between the parabolic section and a screw base used for electrical connection to a line current. The neck region provides mechanical support between the reflector optical portion and the base electrical portion. The neck region also provides room for the lamp capsule, leads, capsule mounting components, electrical wiring, and separates the filament from the base to reduce base temperature.

A conventional PAR lamp is shown in FIG. 1. The lamp 10 includes a lamp capsule 12, a reflector 14 having a neck region 15, a base 16, metal eyelets 18, and a lens 20 that encloses capsule 12 in reflector 14. Capsule 12 may be a press-sealed halogen lamp capsule with leads 22 that extend through respective passageways 24 opening to a heel 26 of the reflector 14. The eyelets 18 are in the passageways 24 and grip the leads 22 to hold the capsule 12 in the reflector 14. Alternatively, ferrules, ceramic or cement may be used instead of the eyelets 18 to hold the capsule in the reflector. The reflector 14 may be a glass shell that is preferably a body of revolution with an interior side 28 coated with a reflective coating. The base 16 includes respective, electrically separated, terminals 30 for the lamp. The leads 22 are attached to the respective terminals with wires 32.

With reference now to FIG. 2 that depicts a series of steps in the manufacture of a conventional PAR lamp, the lamp is assembled by inserting the eyelets 18 and then inserting the capsule 12 from the front aperture of the reflector and attaching capsule leads at the reflector heel by means of the eyelets 18. The capsule 12 is supported solely by crimping both of the leads 22 in the eyelets 18 that are compressed into the passageways 24. Automated assembly of the eyelets and capsule into the reflector requires very tight tolerances for the dimensions and placement of the passageways. These tight tolerances increase the cost of the reflector.

In another common PAR lamp construction, the capsule is supported on a metal disk that rests on a shelf in the reflector neck region. Axial movement of the capsule and disk assembly is prevented by crimping metal eyelets to the capsule leads near the heel, pulling the capsule and disk assembly tight to the shelf. The support disk construction does not require the tight passageway tolerance, but the added metal disk and more complex assembly increases manufacturing cost.

Much of the light entering the neck region of PAR lamps is lost due to multiple reflection and absorption by the mounting and capsule components and does not contribute to the beam. It is well known that the cross-sectional area for the capsule inside the reflector should be as small as possible to maximize beam intensity and lamp efficiency (as defined by lamp lumens divided by source lumens). However, both inner and outer surfaces of the reflector must have a suitable draft angle for removal from a mold. The pressed glass reflector therefore commonly used for PAR lamps typically has a minimum draft angle of 3 degrees but in practice, a 5-degree draft angle is typically used. The neck region must also have adequate diameter to fit the capsule mounting devices. When the capsule is supported solely by the leads crimped by the eyelets, the neck region inner diameter must be large enough to make space for the flared ends of the eyelets. This increases the neck region diameter. The flares also require a flat surface on which to seat, which, in turn, creates snag points when the capsule is inserted. Some of the lead ends catch on the flat surface, resulting in failed insertions and causing the product to be scrapped.

DISCLOSURE OF THE INVENTION

An object of the present invention is to provide a novel lamp and method of making the lamp that avoids the problems of the prior art.

The lamp includes a reflector having a passageway that opens to a heel of the reflector, a lamp capsule having a lead that extends rearward through the passageway, a conductive clip that spans a diameter of the heel and that has tabs that extend forward at opposite sides of the heel, the clip having a lead attachment such as an arm that extends rearward and that is attached to a portion of the lead that projects out of the passageway, and a base that is attached to the heel and that engages the tabs at the opposite sides of the heel. The arm holds the lamp capsule in place and electrically connects the lamp capsule to the base.

A method of making the lamp includes the steps of clipping the clip to the heel and attaching the arm of the clip to the capsule lead to hold the capsule in the reflector. The arm may be a semi-detached central portion of the clip that is bent to be substantially parallel to an axis of the lead.

These and other objects and advantages of the invention will be apparent to those of skill in the art of the present invention after consideration of the following drawings and description of preferred embodiments.

BEST MODE FOR CARRYING OUT THE INVENTION

Figure 1:
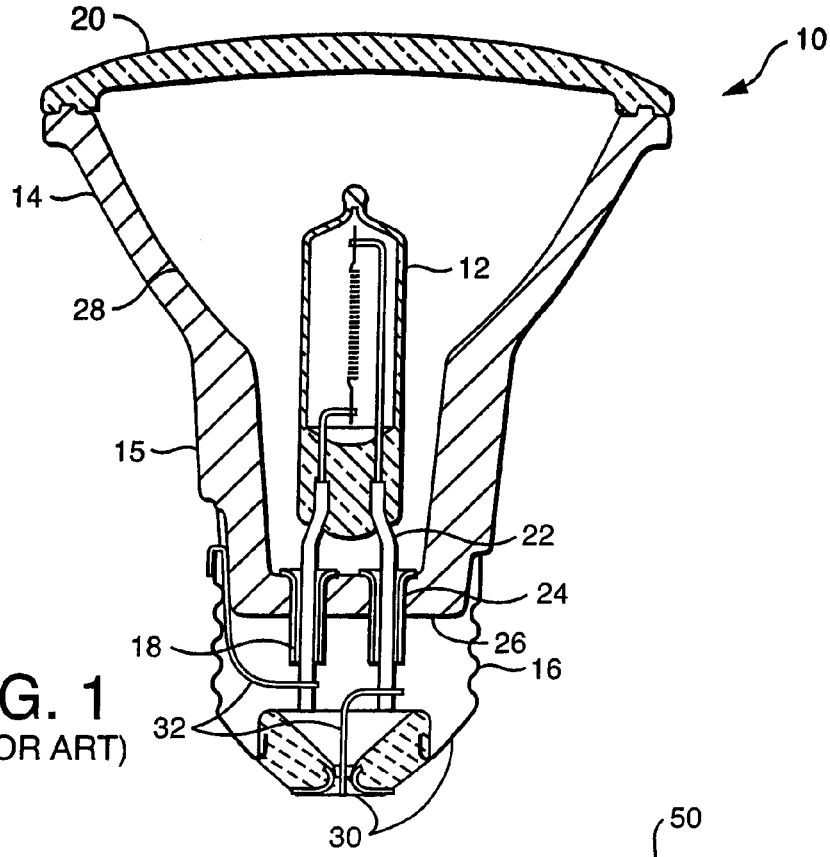
FIG. 1 (PRIOR ART)
FIG. 1 is a cross section of a conventional PAR lamp.

With reference now to FIGS. 3 and 4*a-c*, a lamp 50 of the present invention includes a lamp capsule 52, a reflector 54 with a neck region 55, a base 56, and a lens 58 that encloses capsule 52 in reflector 54. The capsule 52 may be a suitable light source with leads 60 that extend through passageways 62 that open to a heel 64 of the reflector 54. The reflector may be a glass shell that is preferably a body of revolution with a reflective coat on an interior side.

The capsule 52 is held in the reflector 54 with a conductive clip 70 (seen more clearly in FIGS. 4*a-c*) that spans a diameter of the heel 64 and that has tabs 72 that extend forward at opposite sides of the heel. The clip 70 has a lead attachment such as an arm 74 that extends rearward and that is attached to a portion of one of the leads 60 that projects out of one of the passageways 62. The arm 74 may be attached to the lead by soldering, welding, an adhesive, or other suitable means, such as by wrapping the arm around the lead and crimping the arm 74 onto the respective lead (see FIG. 4*c*). The attachment of the arm to one of the leads holds the capsule in the reflector. The preferred clip is formed from a resilient metal and is generally U-shaped, and may be a stainless steel with a high modulus of elasticity and high yield strength.

A base 56 is attached to the heel 64 and engages the tabs 72 at the opposite sides of the heel. The base 56 holds the clip 70 in place on the heel to securely position and hold the capsule 52. The base 56 includes separate terminals for the lamp and may be a standard threaded metal shell with a sidewall 76. One terminal is formed by the sidewall 76 that engages the tabs 72 so that power is provided to the capsule 52 via the sidewall 76, clip 70 and one of the leads 60. The other terminal in the base may be a standard insulated islet 78 positioned axially and including a glass gob supporting a metal ferule.

Figure 4A:
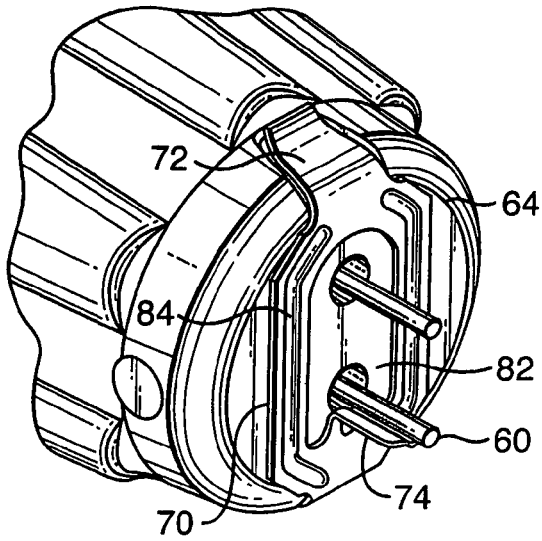
FIGS. 4*a-c* are pictorial depictions of three embodiments of the clip of the present invention.
Figure 4B:
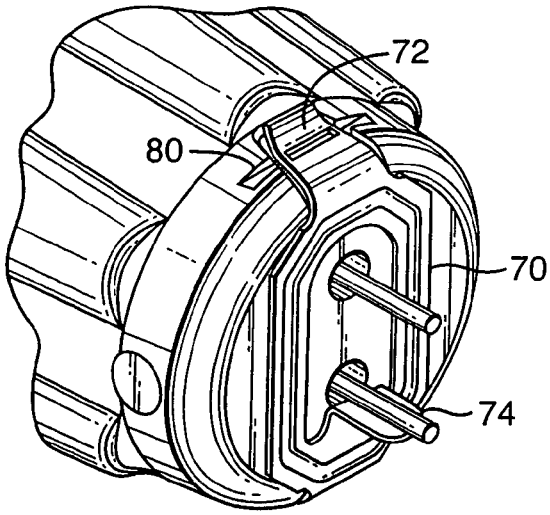
Figure 4C:
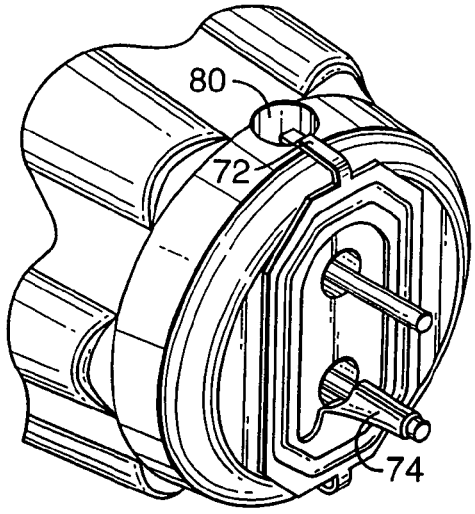

As shown in FIG. 4*a*, the tabs 72 may resiliently grip the opposite sides of the heel 64 to hold the clip in place during manufacture of the lamp. Alternatively, as shown in FIGS. 4*b* and 4*c*, the heel 64 may have recesses 80 at the opposite sides and the tabs 72 may fit into the recesses. The recesses may be slots cut into the base and the tabs may have corresponding dimples, such as shown in FIG. 4*b*, or the recesses may take other shapes and receive an end of the tabs, such as shown in FIG. 4*c*. The construction shown in FIG. 4*c* requires no extra cutting operation as the tabs snap into the existing peen holes in the reflector. The tabs are then deformed during base peening making positive electrical contact and locking the clip firmly in place. The tabs could also extend over the edge of the base and be welded to the outside.

As is shown in FIGS. 4*a-c*, the clip may be generally O-shaped with a central opening 82 through which one or both of the leads extend. The arm 74 may depend from an interior side of central opening 82. The clip 70 may also include a stiffening bead or dimple 84 around at least part of a periphery of the central opening.

With reference again to FIG. 3, the other of leads 60 (the one not connected to the arm of clip) may be attached with a wire 86 to a further terminal (e.g., conventionally in the bottom of the base) that is electrically isolated from the part of the base that is electrically connected to the clip 70. One or both of the leads may extend through the central opening of the clip, taking care that the other lead does not contact the clip.

Figure 3:
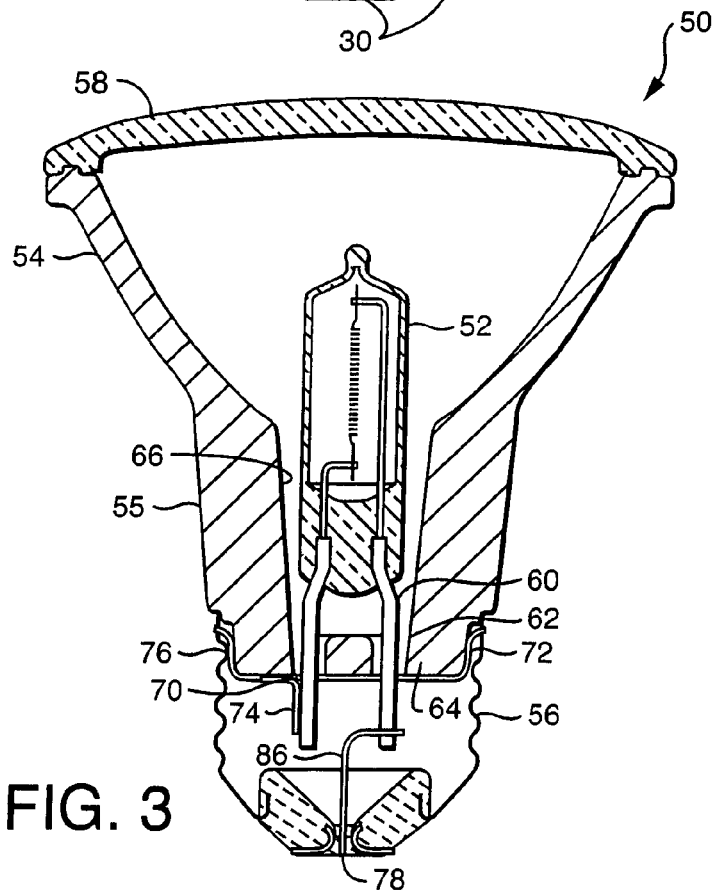
FIG. 3 is a cross section of an embodiment of a lamp of the present invention.
Figure 2:
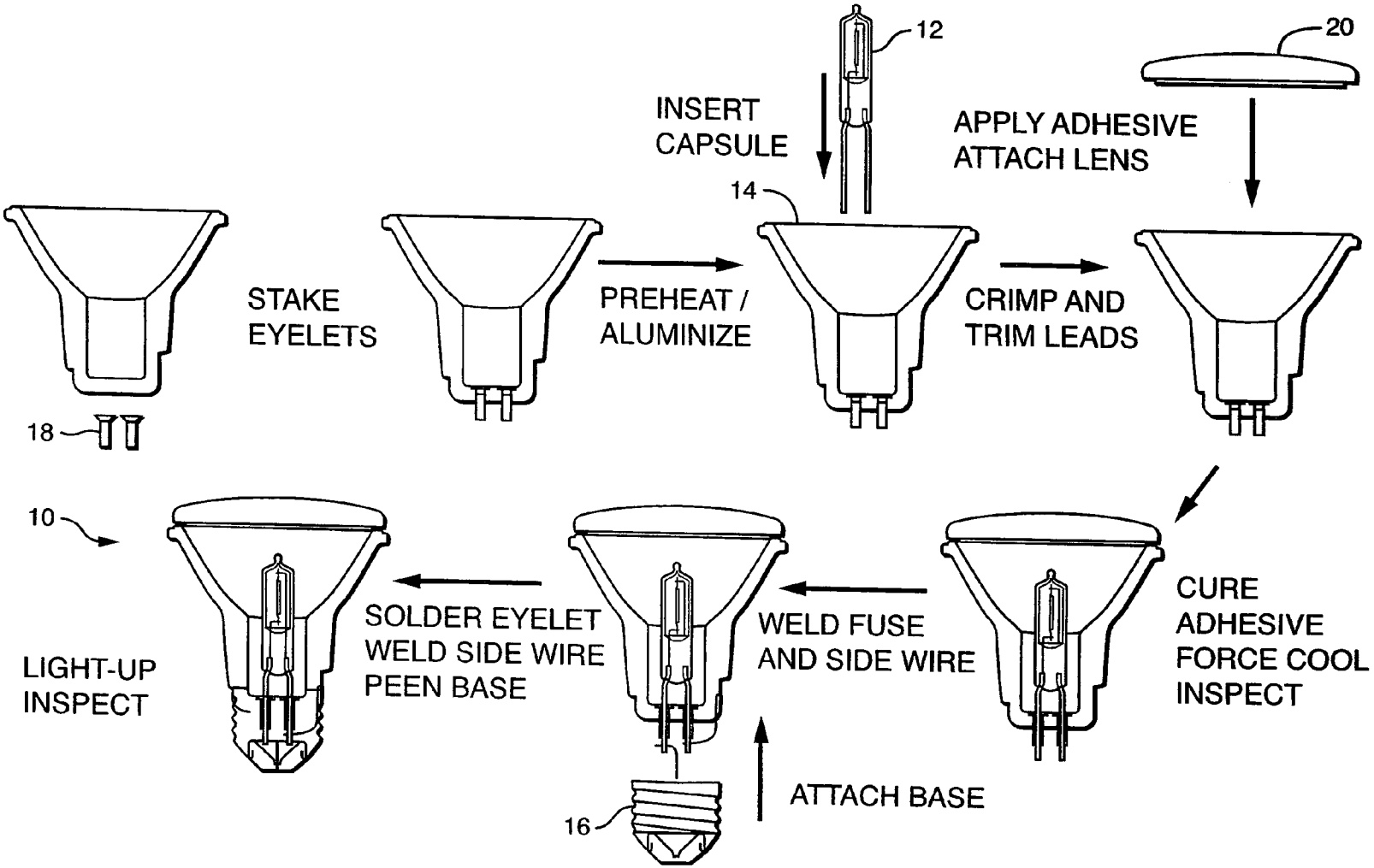
FIG. 2 depicts the series of steps in the manufacture of a conventional PAR lamp.

As seen in the cross section of FIG. 3, an interior side 66 of the neck region 55 surrounding a rear part of the capsule may be collinear (flush) with an outer edge of at least one of the passageways 62. This arrangement helps avoid at least some of the edges that snag the capsule leads when they are inserted into the passageways in the prior art (compare FIG. 1 that includes the flat surface at the base of the interior neck region for the flare of eyelet 18).

The arm 74 may be substantially parallel to an axis of the lead 60 to which it is attached. The arm may be a semi-detached part of the clip (the arm being detached from the clip on three sides of the arm) that has been bent to be transverse to the heel, thereby forming the central opening 82 and the arm 74 at the same time.

Figure 5:
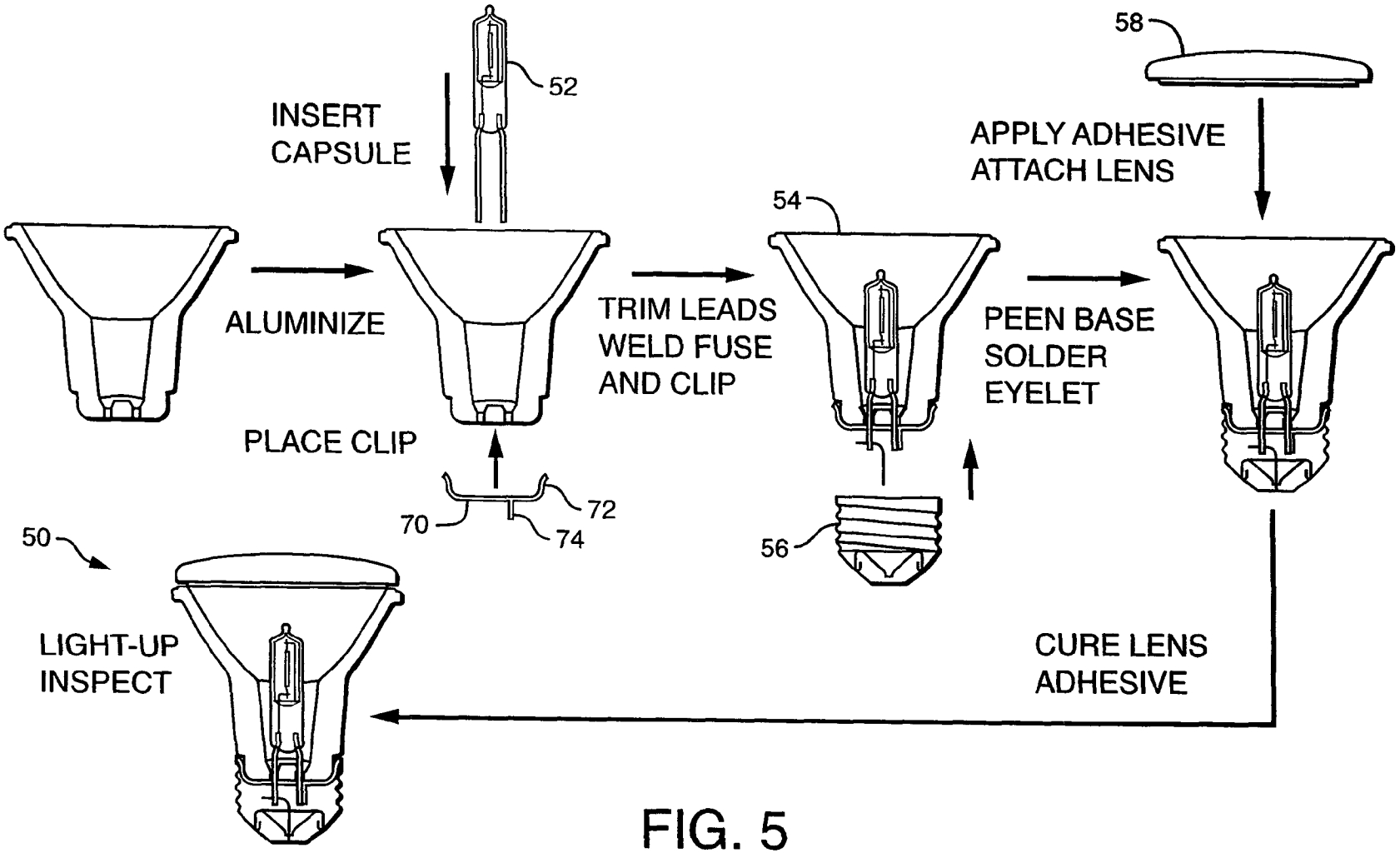
FIG. 5 depicts the series of steps in the manufacture of the lamp of FIG. 3.

With reference now to FIG. 5, the lamp may be assembled by clipping the clip to the heel of the lamp while aligning a portion of the clip, such as the arm, and the central opening with the respective passageways opening to the heel. The lamp capsule is then inserted in the reflector, guiding the leads through the respective passageways. One of the leads is electrically connected to a portion of the clip, such as the arm, for example by soldering or welding or crimping. The lamp capsule is now retained accurately for the remaining assembly steps. The other lead 60 may be passed through the central opening and may be electrically coupled, for example by welding, to wire 86. The base 56 is then threaded over the end of the reflector and clip assembly. The arms 72 of the clip 70 are thereby compressed into firm contact with the heel of the reflector 54 and at the same time make good electrical contact with the sidewall of the base. The base 56 is coupled to the reflector 54, for example, by peening or crimping the base to the reflector. Alternatively the base may be cemented to the reflector in a conventional manner.

This method of manufacture requires no eyelets or cement and no disk attached to the capsule to hold the capsule in place. The capsule is supported entirely be a single lead attached to the clip that rests on the heel. The tabs are compressed by the base and held tightly against the sides of the heel. The external lamp dimensions and appearance are not affected by the new structure. The direct electrical contact of clip-to-base eliminates the need for a wire connecting the capsule lead to the base sidewall. The side wire weld that attaches the capsule lead to the base is also no longer needed. This reduces machine complexity and material shrinkage. Elimination of eyelets also allows for a much smaller diameter of the neck region for increased light output and beam intensity.

This new construction is compatible with an optimized assembly process where the lens is attached last. This allows light-up testing of the based lamp before adhesive application of the lens so the costly lens and reflector can be reused in the event of capsule defect or base assembly problems.

Using the clip eliminates the eyelets, and therefore the eyelet flares, thereby enabling the funnel shaped lead passages, leading to rapid and accurate insertion of the capsule. It also enables a narrower internal diameter of the neck region resulting in more light output. The clip also eliminates one or two weld steps.

While embodiments of the present invention have been described in the foregoing specification and drawings, it is to be understood that the present invention is defined by the following claims when read in light of the specification and drawings.

What is claimed is:

1. A lamp comprising:

a reflector having a heel at a rear end thereof and a first passageway opening to said heel;

a lamp capsule in said reflector and having a first lead that extends rearward through said first passageway;

a conductive clip that spans a diameter of said heel and that has tabs that extend forward at opposite sides of said heel, said clip having an arm that extends rearward and that is attached to a portion of said first lead that projects out of said first passageway to hold said lamp capsule in said reflector; and a base that is attached to said heel and that engages said tabs at the opposite sides of said heel.

2. The lamp of claim 1, wherein said tabs resiliently grip the opposite sides of said heel.

3. The lamp of claim 1, wherein said heel includes recesses at the opposite sides thereof and wherein said tabs fit into said recesses.

4. The lamp of claim 1, wherein said clip is generally O-shaped with a central opening through which said first lead extends and wherein said arm depends from an interior side of said central opening.

5. The lamp of claim 4, wherein said clip further comprises one of a stiffening bead and a dimple around at least part of a periphery of said central opening.

6. The lamp of claim 1, wherein said reflector has a second passageway that opens at said heel and said lamp capsule further comprises a second lead that extends rearward through said second passageway.

7. The lamp of claim 6, further comprising a wire connecting said second lead to a bottom of said base that is electrically isolated from a part of said base that engages said tabs.

8. The lamp of claim 6, wherein said clip has one or more openings through which said first and second leads extend, wherein said arm depends from a side of said central opening into contact with said first lead, and wherein said second lead does not contact said clip.

9. The lamp of claim 1, wherein said arm is substantially parallel to an axis of said first lead.

10. The lamp of claim 1, wherein said arm is a semi-detached portion of said clip that is bent transverse to said heel.

11. The lamp of claim 1, wherein said arm is crimped to said first lead.

12. The lamp of claim 1, wherein said reflector has a neck region surrounding a rear part of said capsule and, in cross section, an interior side of said neck region is collinear with an outer edge of said passageway.

13. A method of assembling a lamp, comprising the steps of:

providing a reflector that has a heel at a rear end thereof and a first passageway that opens to the heel;

positioning a conductive clip on the heel with the clip spanning a diameter of the heel, the clip having tabs that extend forward at opposite sides of the heel and a lead attachment;

positioning a lamp capsule in the reflector, the lamp capsule having a first lead that extends rearward through the first passageway;

attaching the lead attachment to a portion of the first lead that projects out of the first passageway to hold the lamp capsule in the reflector; and attaching a base to the heel with the base engaging the tabs at the opposite sides of the heel.

14. The method of claim 13, further comprising the step of bending the lead attachment away from the clip to form an arm extending as a semi-detached portion of the clip.

15. The method of claim 13, further comprising the step of resiliently gripping the opposite sides of the heel with the tabs.

16. The method of claim 13, further comprising the steps of providing recesses in the opposite sides of the heel and fitting the tabs into the recesses.

17. The method of claim 13, wherein the clip has a central opening through which the first lead extends and further comprising the step of bending an interior side of the central opening to form the lead attachment.

18. The method of claim 17, further comprising the step of providing one of a stiffening bead and a dimple around at least part of a periphery of the central opening.

19. The method of claim 13, wherein the reflector has a second passageway that opens to the heel and the lamp capsule further includes a second lead that extends rearward through the second passageway and further comprising the step of connecting a wire to the second lead and to a bottom of the base that is electrically isolated from a part of the base that engages the tabs.

20. The method of claim 13, wherein the reflector has a neck region surrounding a rear part of the capsule and further comprising the step of making, when viewed in cross section, an interior side of the neck region collinear with an outer edge of the passageway.

21. A method of assembling a lamp, comprising the steps of:

providing a reflector that has a heel at a rear end thereof and a first passageway that opens to the heel;

providing a conductive clip having engagement members that engage opposite sides of the heel and further having a lead attachment;

holding the clip on the heel by engaging the engagement members of the conductive clip on the heel with the clip spanning opposed lateral wall portions of the heel;

positioning a lamp capsule in the reflector, the lamp capsule having a first lead that extends rearward through the first passageway;

attaching the lead attachment to the first lead to hold the lamp capsule in the reflector; and attaching a base to the heel with the base contacting the conductive clip.

22. The method of claim 21, wherein the lamp capsule has a second lead, and further comprising the step of attaching, subsequent to the step of positioning the lamp capsule in the reflector, solely one further conductive lead, said one further conductive lead being attached to the second lead of the lamp capsule and to a bottom of the base that is electrically isolated from a portion of the base that contacts the conductive clip.

23. The method of claim 21, wherein the step of attaching the lead attachment to the first lead is performed subsequent to the step of holding the clip on the heel without being preceded by a step of applying a cement to the clip.

* * * * *